US005656790A

United States Patent [19]

Adachi

[11] Patent Number: 5,656,790

[45] Date of Patent: Aug. 12, 1997

[54] MUSICAL SOUND SYSTEM INCLUDING A MAIN UNIT FOR PRODUCING MUSICAL SOUNDS AND A CONTROL UNIT FOR CONTROLLING THE MAIN UNIT

[75] Inventor: Jun Adachi, Hamamatsu, Japan

[73] Assignee: Yamaha Corporation, Hamamatsu, Japan

[21] Appl. No.: 145,978

[22] Filed: Oct. 29, 1993

[30] Foreign Application Priority Data

Nov. 2, 1992 [JP] Japan ..... 4-293606

[51] Int. Cl.[6] ..... G10H 7/00

[52] U.S. Cl. ..... 84/601

[58] Field of Search ..... 84/600–602, 645

[56] References Cited

U.S. PATENT DOCUMENTS 4,700,604 10/1987 Morikawa et al. .
5,046,004 9/1991 Tsumura et al. ..... 84/645 X
5,127,303 7/1992 Tsumura et al. ..... 84/645 X
5,252,775 10/1993 Urano ..... 84/645
5,262,580 11/1993 Tanaka et al. ..... 84/645 X
5,300,725 4/1994 Manabe ..... 84/645 X

*Primary Examiner*—William M. Shoop, Jr.
*Assistant Examiner*—Jeffrey W. Donels
*Attorney, Agent, or Firm*—Graham & James

[57] ABSTRACT

A musical sound system is operated according to a selected set of a system program and a control program, which are separate from each other and which are related consistently to each other. The system is comprised of a sound unit and a control unit. The sound unit is operable based on a selected system program for producing a musical sound. The sound unit has a floppy disk driver for loading into the sound unit the selected system program and for concurrently loading a control program corresponding to the selected system program, and has a communication interface for transmitting the loaded control program. The control unit receives the transmitted control program for controlling the sound unit according to the control program to thereby hold consistency between operations of the sound unit and the control unit.

8 Claims, 12 Drawing Sheets

MUSICAL SOUND SYSTEM INCLUDING A MAIN UNIT FOR PRODUCING MUSICAL SOUNDS AND A CONTROL UNIT FOR CONTROLLING THE MAIN UNIT

BACKGROUND OF THE INVENTION

The present invention relates to a musical sound system and a musical sound network, which are composed of a plurality of electronic musical instruments interconnected with each other to operate systematically for achieving organized musical performance. More specifically, the present invention relates to systematic organization and harmonization of separate programs loaded into respective electronic musical instruments of the system or network.

An old electronic musical instrument is operated by a built-in program which is fixed and therefore not changeable. Recently, an advanced electronic musical instrument has been developed such that a system program thereof is loaded at the time of starting or resetting the instrument in order to facilitate version-up and modification of the program. Further, a plurality of the electronic musical instruments are connected with each other to constitute a musical sound system for achieving a total musical performance. In such a case, version-up or modification of the program must be effected totally throughout the system. However, individual electronic musical instruments operate independently of each other in the system, and they are loaded with separate programs. Therefore, the conventional musical sound system suffers from drawbacks that version-up and modification of the separate programs are complicated and troublesome while maintaining consistency among the separate programs. For example, it is necessary to update each program one by one in the system.

SUMMARY OF THE INVENTION

In view of the above noted drawbacks of the prior art, an object of the invention is to facilitate maintenance of individual programs which must be kept consistently with each other and which must be organized and harmonized with each other in the musical sound system or musical sound network.

According to a first aspect of the invention, the musical sound system is operable according to a selected set of a system program and a control program, which are separate from each other and which are related consistently to each other. The system comprises a main unit and a control unit. The main unit is operable based on a selected system program for producing a musical sound. The main unit includes loading means for loading thereinto the selected system program and for concurrently loading thereinto a control program corresponding to the selected system program, and transmitting means for transmitting the loaded control program. The control unit is receptive of the transmitted control program for controlling the main unit according to the transmitted control program to thereby hold consistency between operations of the main unit and the control unit.

According to a second aspect of the invention, the musical sound network comprises a plurality of sound stations being operable independently from each other for producing a musical sound according to a given data, and a data station connected to the respective sound stations through a communication channel. The data station includes means for storing a plurality of data, and means responsive to requests from the respective sound stations for transmitting thereto different data.

According to a third aspect of the invention, the musical sound network comprises a plurality of sound stations controllable independently from each other for producing a musical sound, and at least one control station connected to the respective sound stations through communication channels for selectively controlling each of the sound stations.

According to a fourth aspect of the invention, the musical sound network comprises a first station operable according to a first program for effecting a desired musical sound production, and a second station connected to the first station and being cooperative with the first station for effecting the desired musical sound production according to a second program which is consistent with the first program. One of the first and second stations includes means for changing its own program, and the other of the first and second stations includes means for concurrently changing its own program to thereby maintain consistency between the first program and the second program.

DETAILED DESCRIPTION OF EMBODIMENTS

Figure 1:
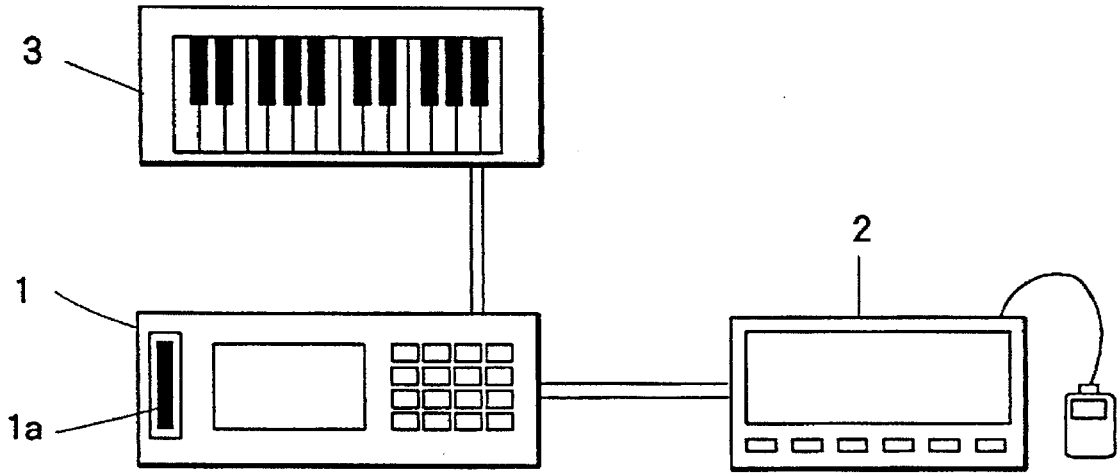
FIG. 1 is a schematic structural diagram showing a first embodiment of the inventive musical sound system.

FIG. 1 is a structural diagram showing a first embodiment of the electronic musical instrument system according to the present invention. The system is composed of a main unit or sound unit in the form of a sound module 1 which is provided with a floppy disk driver 1*a*, a control unit or a controller 2 which is connected to the sound module 1 through a cable, and a play unit such as a keyboard 3. The keyboard 3 is operated by a player to feed a performance data (MIDI data) to the sound module 1 in response to key touches. The sound module 1 produces a musical tone signal according to the received MIDI data. Alternatively, the sound module 1 may synthesize a musical tone signal according to an internally memorized sequence data to effect an automatic performance. The controller 2 is a support unit operative to set various parameters which are effective to control or support the operation of the sound module 1.

When the sound module 1 is turned on by applying thereto a power, the sound module 1 retrieves a system program from a floppy disk (FD) which is loaded in the FD driver 1*a* to thereby commence the operation according to the retrieved system program. Concurrently, the sound module 1 transfers to the controller 2 a control program which is also retrieved from the floppy disk. The sound module 1 is comprised of, for example, a digital signal processor (DSP) which sets up and executes a particular process algorithm according to the retrieved system program so as to produce or synthesize the musical tone signal. Stated otherwise, the DSP can change the process algorithm by selecting a different system program. In such a case, the controller 2 needs to load a corresponding control program which is consistent with the selected system program since a control algorithm of the controller 2 must be changed consistently to the process algorithm of the sound module 1.

Figure 2:
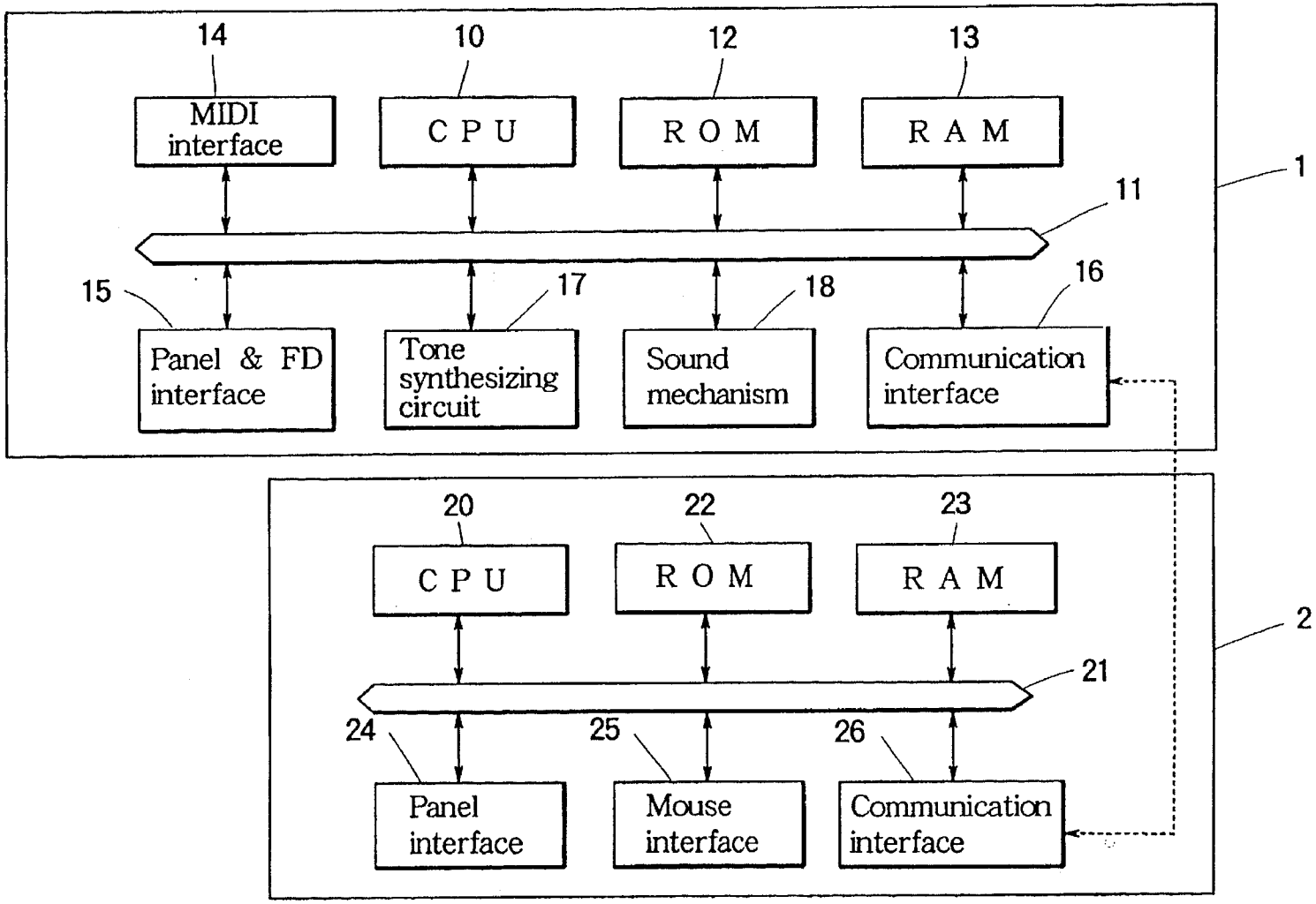
FIG. 2 is a block diagram showing a sound module and a controller included in the musical sound system of FIG. 1.

FIG. 2 is a detailed block diagram of the electronic musical instrument system of FIG. 1. The sound module 1 includes a central processing unit (CPU) 10. The CPU 10 is connected through a bus line 11 to those of ROM 12, RAM 13, MIDI interface 14, panel & FD interface 15, communication interface 16, tone synthesizing circuit 17 and sound mechanism 18. The ROM 12 memorizes an initial program to constitute a bootstrap loader. The RAM 13 provides various memory areas for storing programs retrieved from the floppy disk, tone color data and so on. The MIDI interface 14 connects to those of a play unit such as the keyboard 1 and a sequencer. The panel & FD interface 15 connects to those of a switch panel and the floppy disk driver 1*a*. The communication interface 16 is utilized to effect data transmission to other units involved in the system or to another remote system. In this case, the communication interface 16 connects to the controller 2 within the present system.

On the other hand, the controller 2 includes a CPU 20. The CPU 20 is connected through a bus line 21 to those of ROM 22, RAM 23, panel interface 24, mouse interface 25 and communication interface 26. The ROM 22 memorizes an initial program of the controller 2. The RAM 23 provides a memory area for storing the control program which is transferred from the sound module 1. The panel interface 24 connects to a switch panel. The communication interface 26 is coupled to the other communication interface 16 of the sound module 1 through a cable. Various communication protocols may be adopted between the controller 2 and the sound module 1. For example, the MIDI protocol can be adopted since the MIDI interface is provided as a standard option. However, another faster communication mode may be adopted advantageously for transfer of the program having vast data volume, because the MIDI data transfer rate is only 1200 bps.

Figure 3:
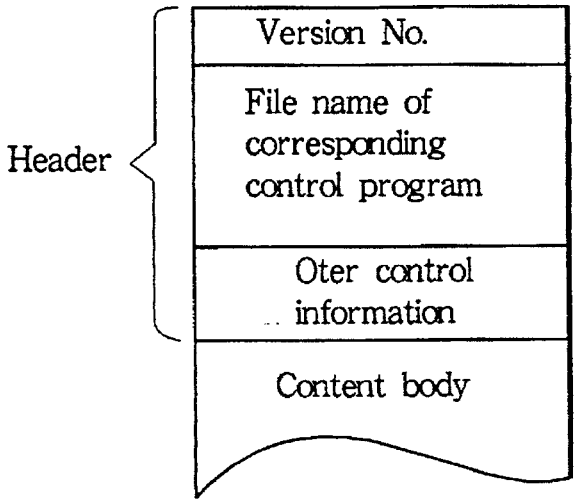
FIG. 3 is an illustrative diagram showing a data format of a system program loaded into the sound module of the first embodiment.

FIG. 3 shows a data format of the floppy disk which is set into the FD driver 1*a*. The floppy disk records a complete set of information including the system program effective to control the operation of the sound module, the control program effective to control the operation of the controller, tone color data used in the sound module, sequence data for use in automatic performance, and so on. The FIG. 3 diagram shows a part of a selected system program. The system program format is divided into a header and a content body. The header contains a version number which identifies the selected system program, a file name which identifies a corresponding control program consistent to the selected system program, and other control information. When the sound module 1 retrieves this system program from the floppy disk, the sound module 1 also retrieves the corresponding control program according to the file name written in the header of the retrieved system program, and then transmits the control program to the controller 2. The content body of the system program determines the tone generation mode of the sound module such as to select either of wave memory reading mode and FM tone generation mode. On the other hand, the controller 2 operates according to the transmitted control program to execute the control of the sound module 1. Though the sound module is composed of the DSP which produces a tone signal by software in the present embodiment, other types of sound modules may be adopted.

Figure 4:
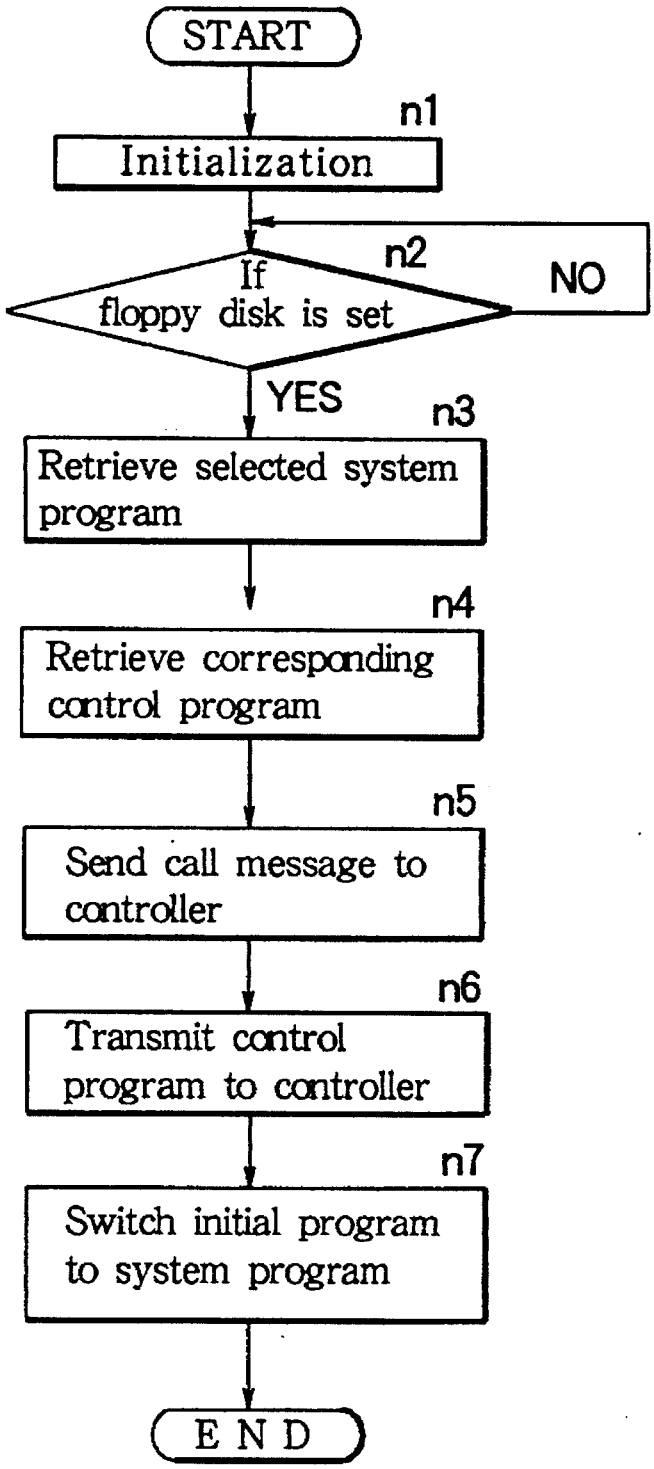
FIG. 4 is a flowchart showing operation of the sound module of the first embodiment.

Next the description is given for the operation of this embodiment with reference to flowcharts. FIG. 4 shows a flowchart of an initial operation of the sound module 1. This initial operation involves transfer of the control program to the controller 2 upon the power-on of the sound module. Firstly in Step n1, initialization is executed according to a given initial program when the power of the system is turned on. In Step n2, check is made as to if a floppy disk is set or loaded in the FD driver 1*a*. Then, Step n3 is undertaken when a floppy disk is loaded for retrieving or reading out a selected system program from the floppy disk. In Step n4, a file name of a corresponding control program is recognized from the header of the retrieved system program, and the corresponding control program identified by the file name is read out from the floppy disk. Concurrently in Step n5, the sound module 1 sends a call message to the controller 2 so that the controller 2 returns a request message for requesting transfer of the control program. Subsequently in Step n6, the control program is transmitted to the controller 2 through a communication channel. After completion of the control program transfer, Step n7 is undertaken so that the initial program is switched to the system program retrieved from the floppy disk to commence the tone generation operation and else in the sound module 1.

Though not explicitly shown in the above flowchart, operation error may occur during the course of the above described processings. In such a case, for example, when an error occurs in the retrieval or transfer of the program, the processing involved in the error is executed again. If the error is not corrected, an additional step may be undertaken to notify occurrence of the error to the operator.

Figure 5:
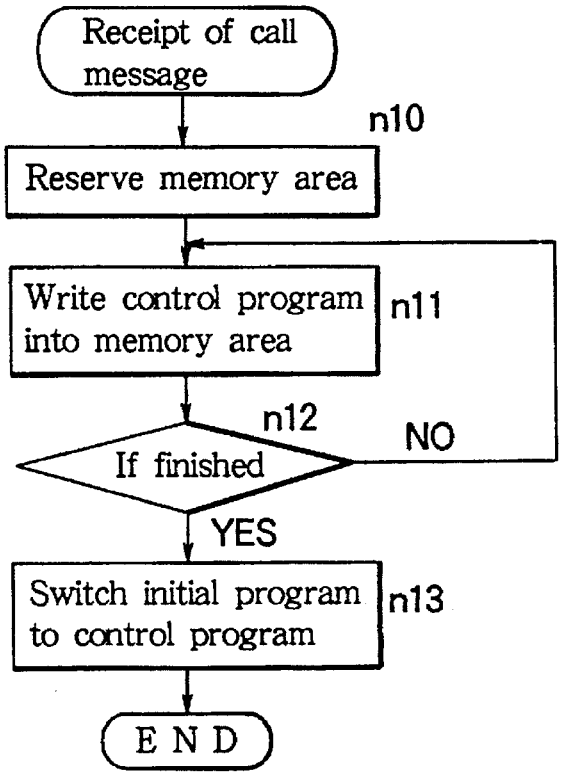
FIG. 5 is a flowchart showing operation of the controller of the first embodiment.

In turn, the controller 2 installs a bootstrap loader likewise the sound module 1 such that an initial program runs when the power is turned on to execute initialization. Then, the controller 2 waits for a call message from the sound module 1. When the controller 2 receives the call message, the controller 2 carries out an interruption program as shown in a flowchart of FIG. 5. In the interruption routine, firstly Step n10 is undertaken to execute initial operation such as to reserve a memory area in the RAM 23. Then, Steps n11 and n12 are continuously carried out to write the transmitted control program in the memory area. After finishing the writing of the control program, the provisional initial program is switched to the control program for operating the controller 2.

By such a process, both of the sound module 1 and the controller 2 are loaded concurrently with selected or updated programs by the single reading operation through the floppy disk driver. The programs are loaded automatically upon the power-on in the present embodiment. Alternatively, the controller may command loading of a new system program such that the above loading operation is commenced upon the command to the sound module from the controller. Further, the pair of the system program and the control program are separately and simultaneously loaded into the respective sound module 1 and the controller 2 in the present invention. However in a modifications three or more separate programs may be loaded into different units of the system. For example, if the keyboard 3 requires a specific program for achieving sophisticated operation, the specific program may be loaded together with the remaining programs, and may be transferred separately to the keyboard 3. Moreover, the system may contain two or more sound units such that one unit may be composed of a source sound module and another unit may be composed of a sequencer. In such a case, the source sound module retrieves a tone color data in addition to its own system program and a corresponding control program. In turn, the sequencer retrieves a sequence data in addition to its own system program and a corresponding control program. Namely, the inventive system can treat not only a program but also can treat a data which is automatically retrieved in combination with the program. Still further, it is not necessary to transfer a whole of the program to the controller, but a part of the program may be transferred. For example, when the tone generation mode is changed in the sound module, a basic part of the control program can be commonly used so that only a modified part may be transferred to save a communication time interval.

Figure 6:
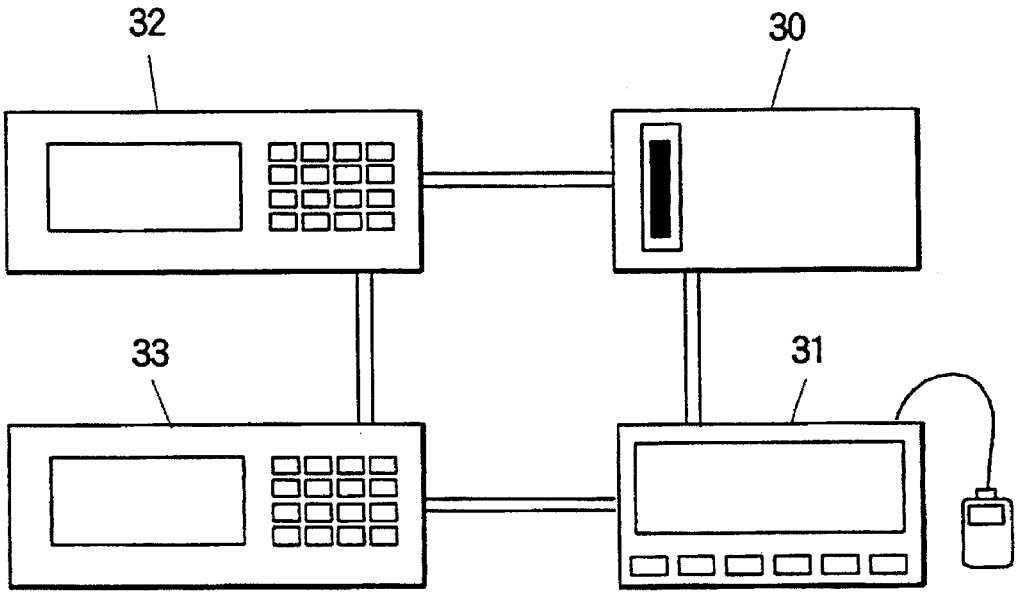
FIG. 6 is a schematic structural diagram showing a second embodiment of the inventive musical sound network.

Next, a second embodiment of the invention will be described with reference to FIGS. 6–15. As shown in FIG. 6, this embodiment represents a network of one control station 31, two sound stations 32, 33 such as an electronic musical instrument or else and a common data station 30 which functions as a data server. The control station 31 selectively controls each of the sound stations through communication channels. The data station 30 operates in response to a data request from each sound station for serving a requested data. The data station 30 is provided with a hard disk driver for dealing with a great data volume at a high speed, in addition to a regular floppy disk driver. The exemplified network has a closed loop; however, the network may have alternatively a bus loop.

Figure 7:
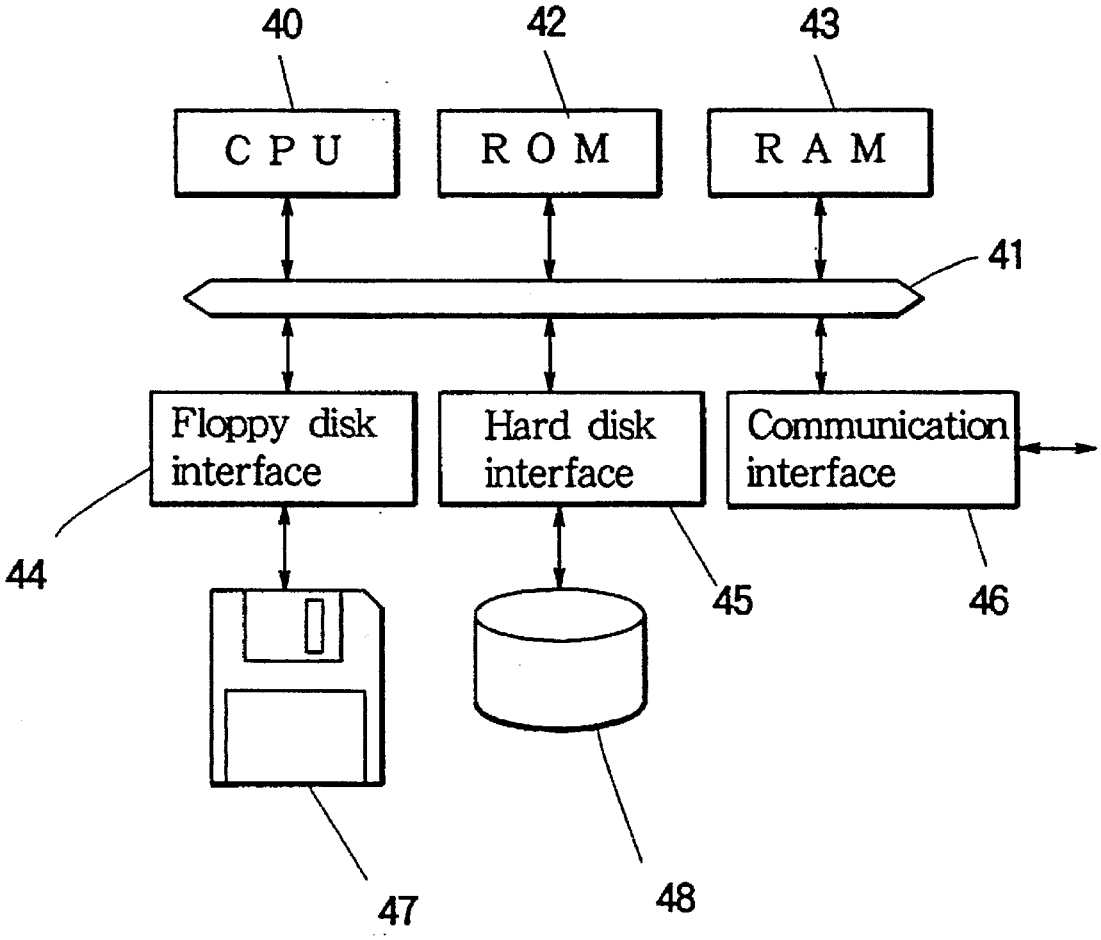
FIG. 7 is a block diagram showing a data station included in the musical sound network of FIG. 6.

FIG. 7 is a block diagram of the data station 30. A CPU 40 is connected through an internal bus line 41 to those of ROM 42, RAM 43, floppy disk interface 44, hard disk interface 45 and communication interface 46. The ROM 42 memorizes an operation program effective to retrieve and transfer various data in response to a data request. The RAM 43 is provided with a memory buffer area for temporarily storing the data to be transferred. The floppy disk interface 44 connects to a FD driver 47. Further, the hard disk interface 45 connects to a hard disk driver 48. The communication interface 46 connects through communication channels to other stations involved in the network.

The control station 31 is comprised of a controller having the same structure as that of the FIG. 1 system. In similar manner, the respective sound stations 32, 33 are comprised of a sound module having the same structure as that of the FIG. 1 system except that a floppy disk driver is eliminated.

Figure 8:
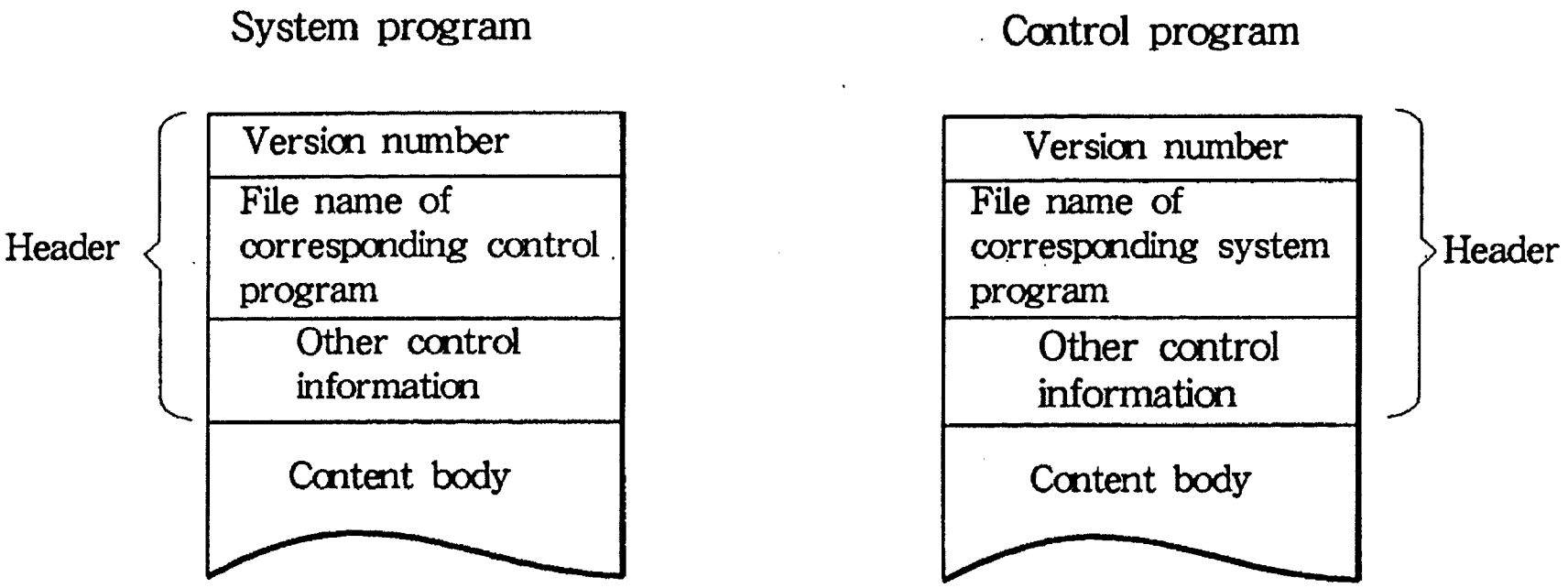
FIG. 8 is illustrative diagrams showing data formats of system and control programs stored in the data station of the second embodiment.

FIG. 8 shows data formats of programs stored in the data station 30. These programs are stored in a floppy disk or a hard disk. The data station 30 stores a system program effective to control operation of each sound station, a control program effective to control operation of each control station as well as tone color data used in each sound station and sequence data for use in automatic accompaniment. The system program is divided into a content body and a header which contains a version number thereof, a file name of a corresponding control program and other various control information. In turn, the control program is divided into a content body and a header which contains a version number thereof, a file name of a corresponding system program and other various control information. Therefore, the corresponding pair of the system and control programs can be referred to with each other in cross manner. Namely, when the system program is loaded precedingly, the corresponding control program can be loaded succeedingly with reference to the file name thereof written in the header of the system program. On the other hand, when the control program is loaded precedingly, the corresponding system program can be loaded succeedingly with reference to the file name thereof written in the header of the control program.

Figure 9:
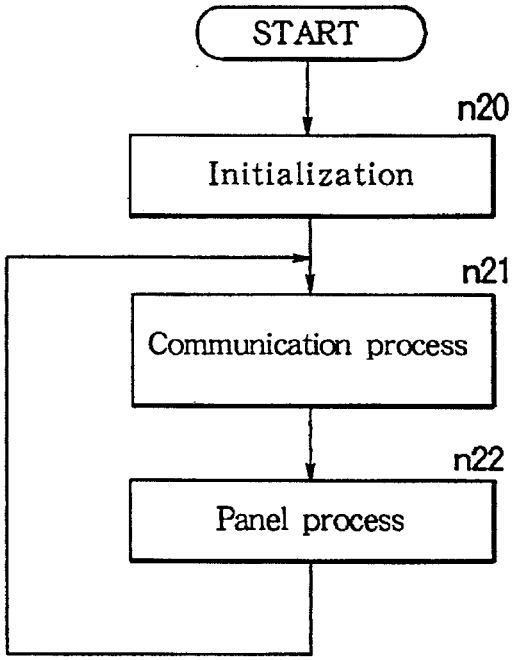
FIGS. 9–11 are flowcharts showing operation of a sound station involved in the second embodiment.
Figure 10:
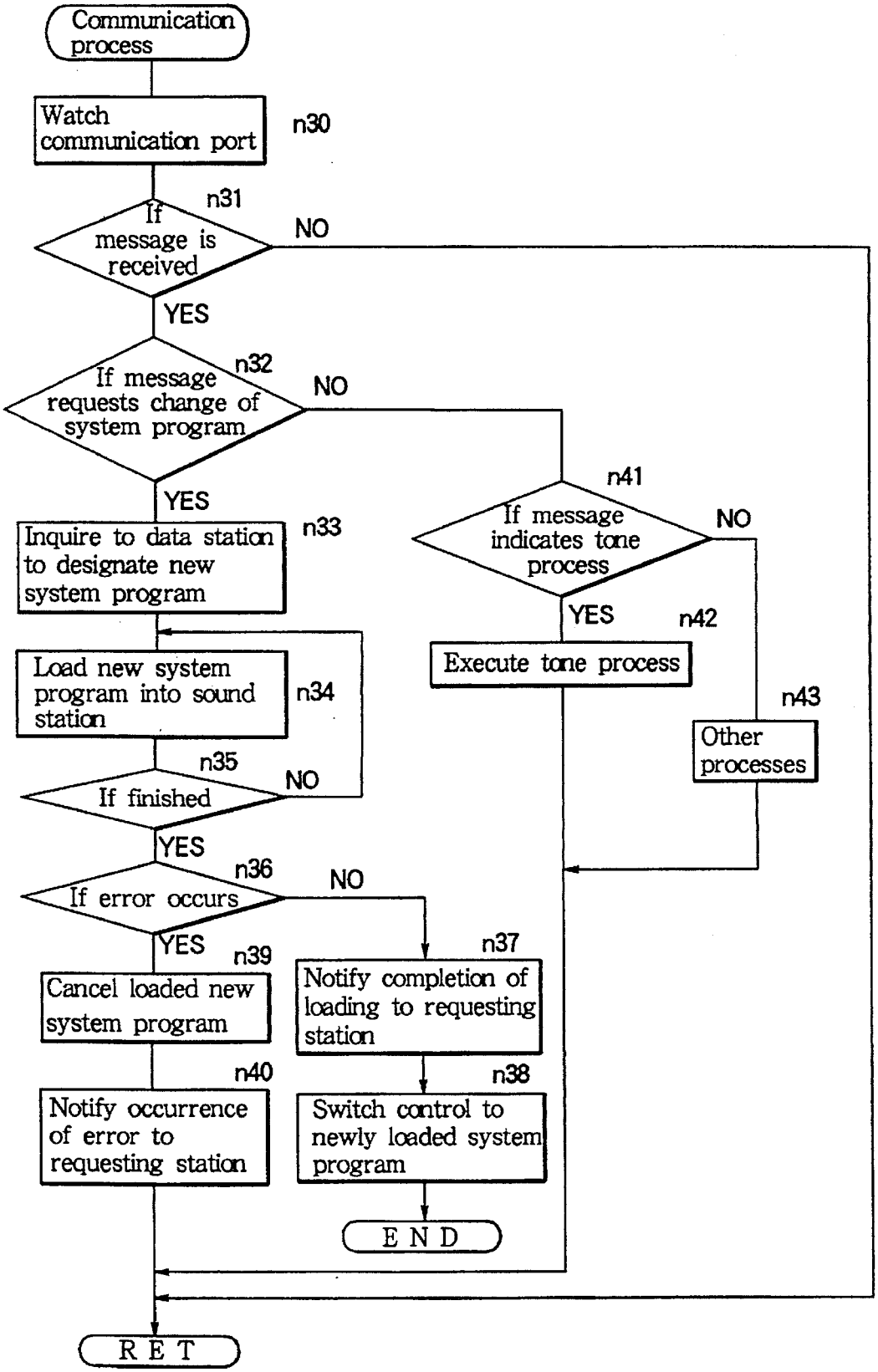
Figure 11:
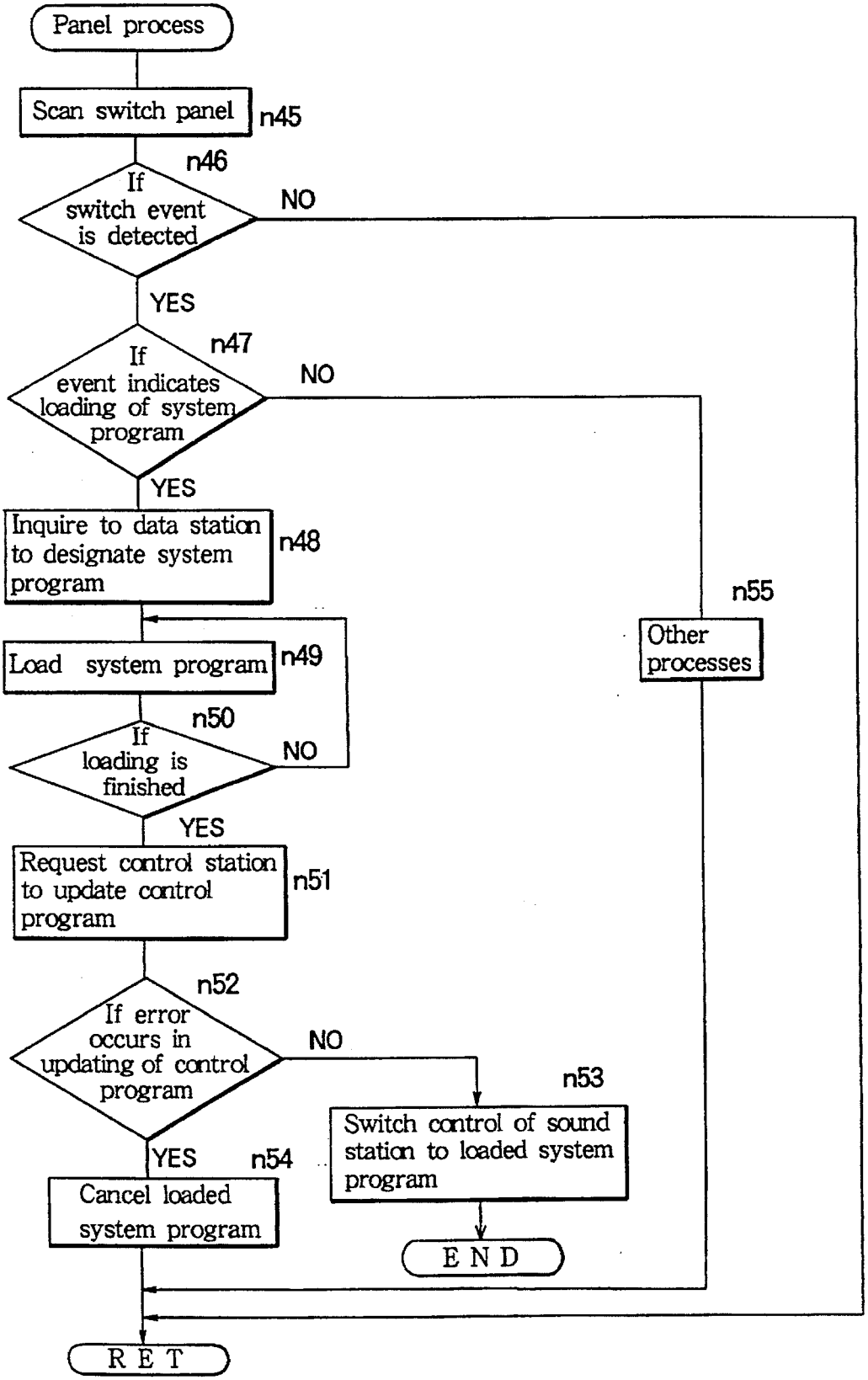

FIGS. 9–11 are flowcharts showing the operation of each of the sound stations 32, 33. FIG. 9 shows a main routine. Firstly, initializing operation is executed in Step n20 to establish an active state. Then, communication process of Step n21 and panel process of Step n22 are repeatedly executed.

FIG. 10 is a flowchart showing a routine executed in the communication process of Step n21. At first, a communication port of the communication interface is watched in Step n30 such that an electric signal received by the communication port is decoded to recognize and discriminate a message addressed to the present receiving sound station. Then Step n31 is undertaken to check as to if a message is received. Further, Step n32 is undertaken to judge as to if the received message requests change of the system program. Such a request message may be transmitted from the control station 31. If the message requests the change of the system program, Step n33 is undertaken to inquire as to if the data station 30 keeps a substitute system program to thereby determine a new system program to be read out. Then, the new system program is loaded into the sound station from the data station 30 in Step n34. Further, Step n35 is undertaken to check as to if the loading of the new system program is finished. Subsequent check is made in Step n36 as to whether an error occurs in the loading operation. If there is no error, Step n37 is undertaken such that the sound station notifies completion of the change or updating of the system program to the requesting control station. Thereafter, Step n38 is undertaken such that the present sound station is subjected to the newly loaded system program. On the other hand, when an error takes place during the course of the loading of the new system program, Step n39 is carried out to cancel or erase the newly loaded system program. Further, Step n40 is undertaken to notify to the control station which requests the updating of the system program, that an error has been brought about, thereby returning.

On the other hand, when the received message indicates other commands than the request of updating the system program, a certain process is carried out. Namely, Step n41 is undertaken to check as to if the message indicates a musical tone process. If so, subsequent Step n42 is undertaken to decode contents of the message to execute the musical tone processing operation. If the message indicates other processes than the musical tone process, Step n43 is undertaken to execute other processes.

FIG. 11 is a flowchart showing the panel process routine executed by each sound station. This panel process is executed, for example, when a switch panel of the sound station is actuated to command updating of its own system program. At first, Step n45 is carried out to scan the switch panel so as to detect either of an on-event and an off-event of any switch on the panel. Then, Step n46 is undertaken to check if an event is detected. If the event is detected, subsequent Step n47 is undertaken to judge as to if the detected switch event indicates a command for loading a new system program. If so, Step n48 is conducted to inquire to the data station 30 if a designated system program is stored, thereby determining the new system program to be retrieved. Then, Step n49 is undertaken to commence loading of the new system program into the sound station from the data station. Further, Step n50 is undertaken to check if the loading of the new system program is finished. If so, subsequent Step n51 is conducted to request the cooperative control station 31 to change or update its own control program corresponding to the new system program. Thereafter, Step n52 is undertaken to check as to if a reply from the control station 31 confirms that no error occurs in the loading of the corresponding control program. If so, Step n53 is undertaken to subject the present sound station to the newly loaded system program. If it is found that the reply indicates an occurrence of error, alternative Step n54 is undertaken to cancel the once loaded system problem, thereby returning. On the other hand, when the event detected on the switch panel indicates other processes than the changing or updating of the system program, Step n55 is undertaken to carry out other processes.

Figure 12:
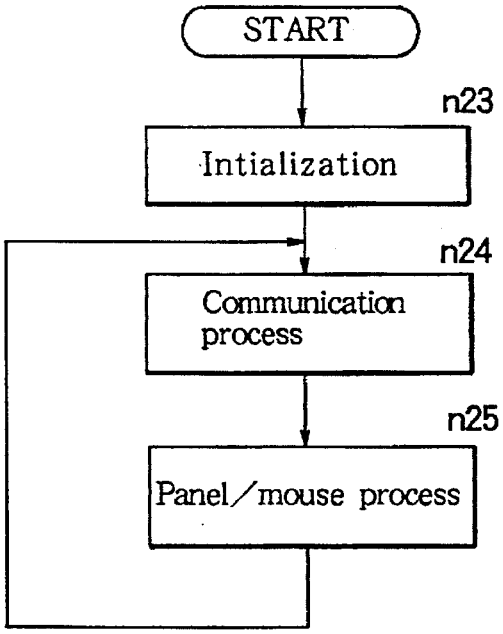
FIGS. 12–14 are flowcharts showing operation of a control station involved in the second embodiment.
Figure 13:
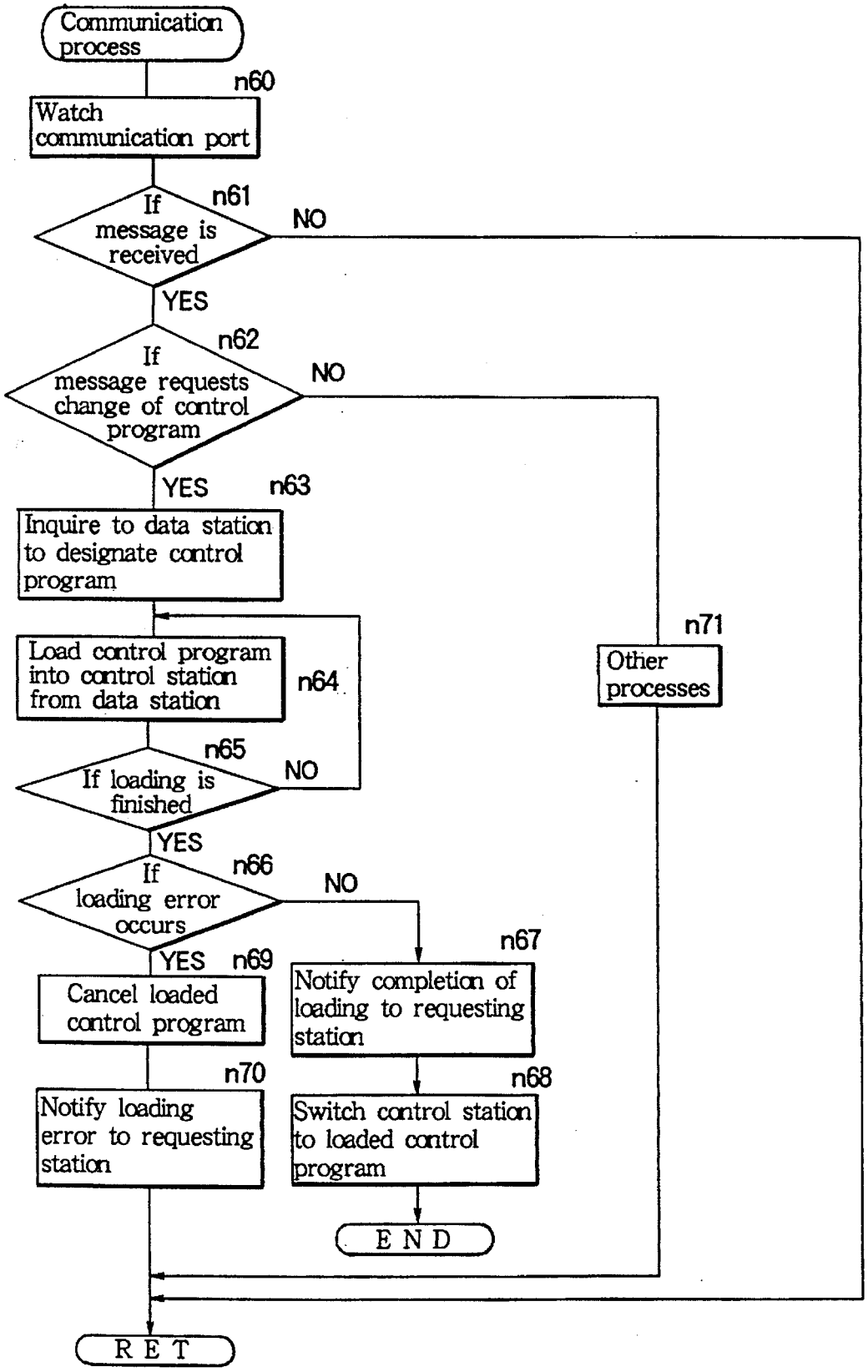
Figure 14:
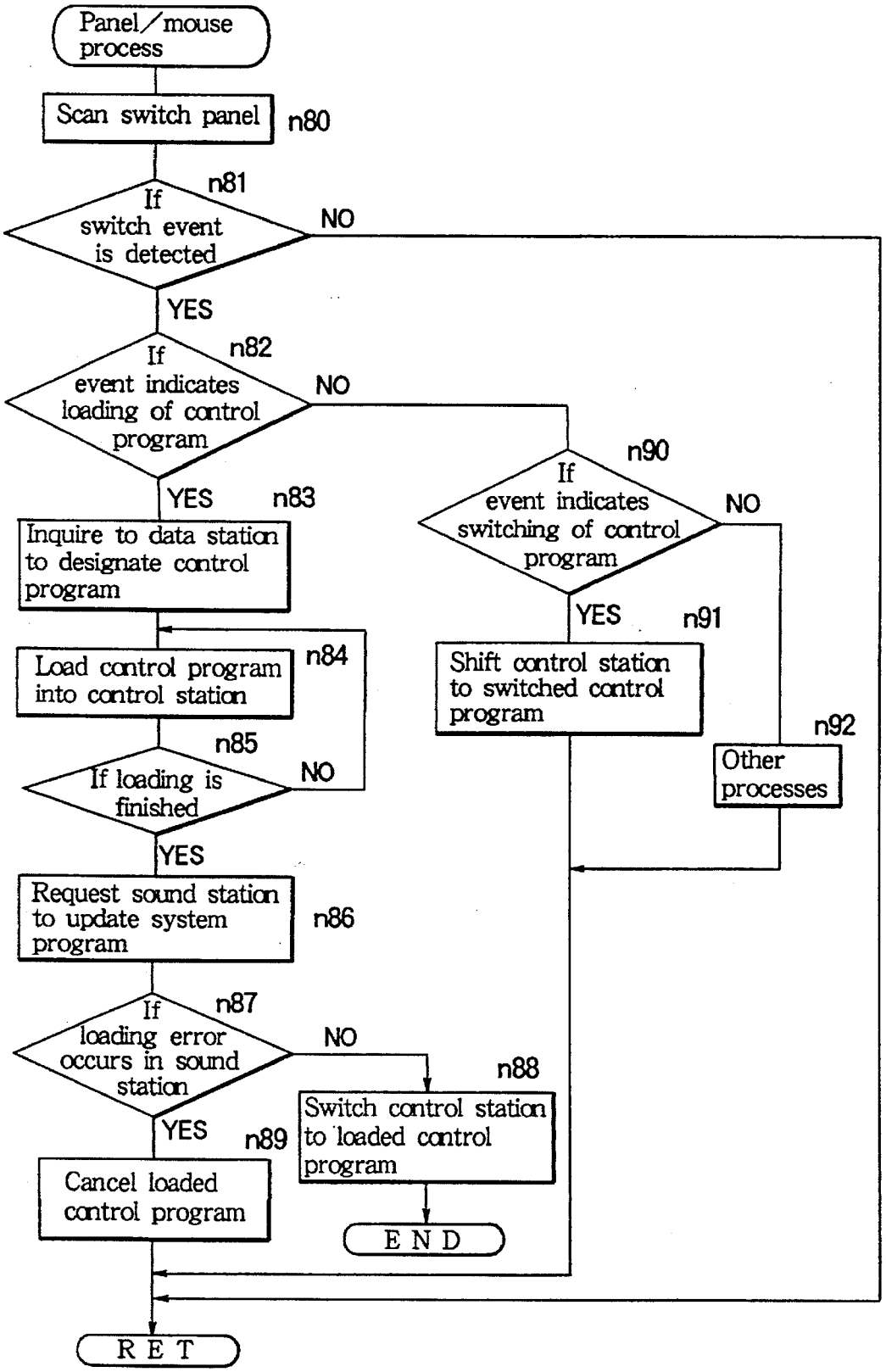

FIGS. 12–14 are flowcharts showing the operation of the control station 31. FIG. 12 shows a flow of a main routine. Namely, after the control station 31 is turned on, Step n23 is undertaken to execute initialization to thereby place the control station in active state. Thereafter, communication process n24 and panel/mouse process n25 are executed repeatedly.

FIG. 13 is a flowchart showing a detailed routine of the communication process executed in the Step n24 of the main routine. First, Step n60 is undertaken to watch a communication port within the control station. Then, Step n61 is undertaken to check if the communication port receives a message. If so, subsequent check is made in Step n62 as to if the received message requests updating of its own control program. Such a request message may be sent from either of the sound stations 32, 33. When the received message requests updating of the control program, Step n63 is undertaken to inquire to the data station 30 if a designated control program is stored to thereby determine the new control program to be retrieved. Then, Step n64 is undertaken to load the new control program into the control station from the data station. Further, Step n65 is undertaken to check as to if the loading of the new control program is finished. After the completion of the control program loading is confirmed, subsequent check is made in Step n66 as to if an error is taken place during the program loading. If not, Step n67 is undertaken to notify to the sound station which requests updating of the control program, that the program loading is finished without error. Thereafter, the control station is subjected to the newly loaded control program in Step n68. On the other hand, when an error is brought about during the control program loading, alternative Step n69 is undertaken to cancel the once loaded control program. Further, Step n70 is undertaken to notify to the requesting sound station that an error has occurred, thereby returning. In case that the received message indicates other processes than the updating of the control program, Step n71 is undertaken to execute other processes.

FIG. 14 is a flowchart showing a detailed routine of the panel and mouse process. This process may be commenced, for example, when a switch panel or a mouse is actuated in the control station to command updating of its own control program. At first, Step n80 is undertaken to scan the switch panel to detect an on-event of a switch. Then, check is made in Step n81 as to if a switch event occurs. Further, check is made in Step n82 as to if the detected switch event indicates change of the control program. If so, Step n83 is conducted to inquire to the data station if a designated control program is stored in the data station to thereby determine a new control program to be retrieved. Then, Step n84 is commenced to load the new control program into the control station from the data station. Further, check is made in Step n85 as to if the loading of the control program is finished. If so, Step n86 is undertaken to request loading of a corresponding system program to each sound station. Thereafter, Step n87 is undertaken to check as to if each sound station replies that no error is taken place during the loading of the corresponding system program. If there is no error, subsequent Step n88 is undertaken to shift the operation of the control station to the newly loaded control program. On the other hand, when the reply from the sound station indicates an occurrence of error, Step n89 is undertaken to cancel the loaded control program, thereby returning. In case that the detected event on the switch panel indicates other processes than the loading of a new control program, the routine is branched to Step n90. Namely, check is made in Step n90 as to if the detected switch event indicates switching of the control program. If so, subsequent Step n91 is undertaken to effect switching of the control program to thereby shift the operation of the control station to the switched control program. On the other hand, when the detected event does not indicate the switching of the control program, Step n92 is undertaken to effect other processes.

Figure 15:
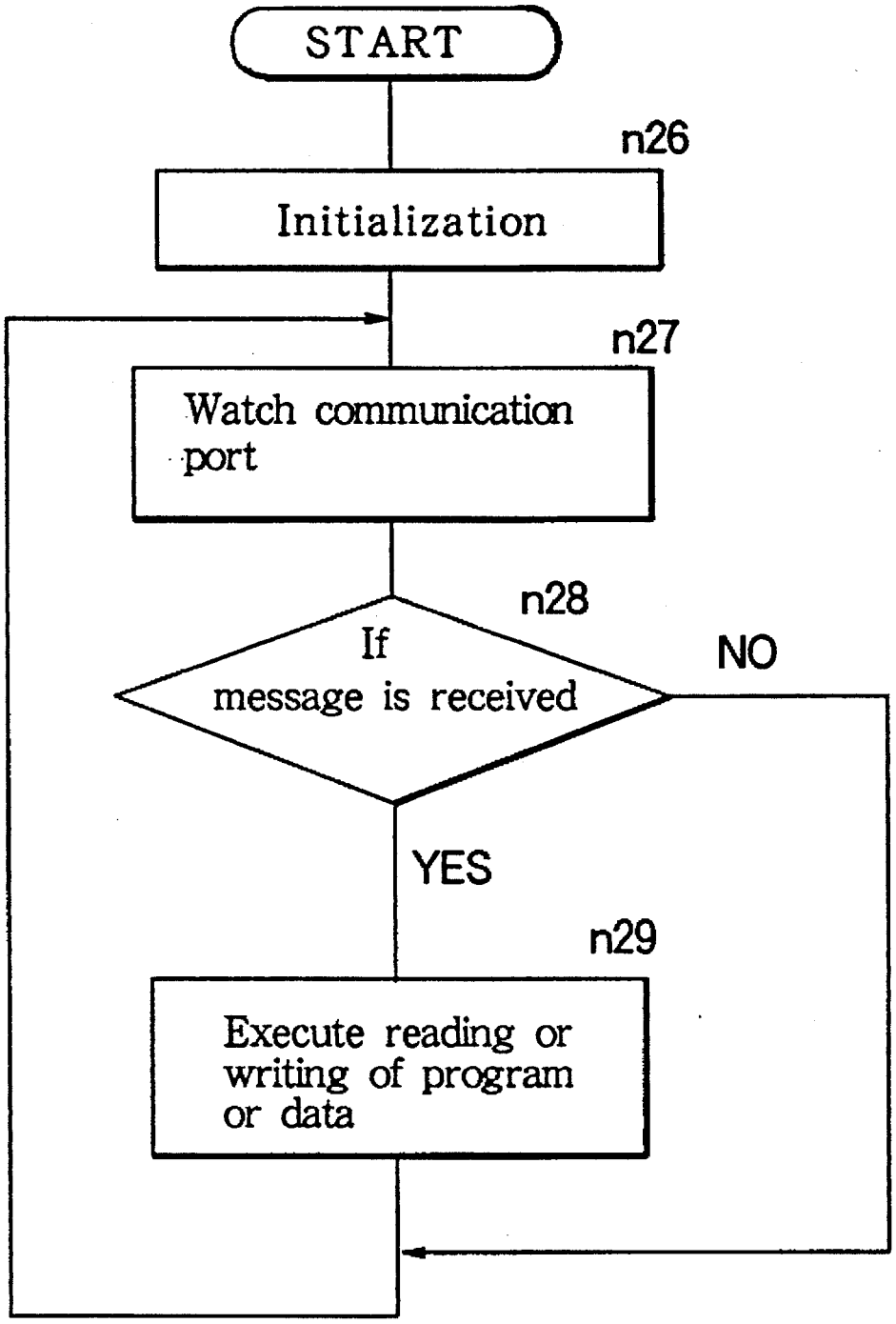
FIG. 15 is a flowchart showing operation of the data station involved in the second embodiment.

Lastly, FIG. 15 is a flowchart showing the operation of the data station 30. After the data station is turned on, Step n26 is undertaken to effect initializing operation to establish an active or accessable state of the data station. Thereafter, Step n27 is undertaken to watch a communication port of the data station. Subsequent Step n28 is undertaken to check as to if a message is received by the communication port. If so, Step n29 is conducted according to contents of the received message to effect reading or writing of various programs and data. The data station responds to requests from the respective sound and control stations for transmitting thereto different programs and data.

Though not explicitly shown in the second embodiment, a keyboard may be connected to a sound station composed of a sound source module, by means of an MIDI cable. Alternatively, a keyboard is connected to the network so as to transmit a performance event as a message. In the above described embodiments, a program is transferred among a plurality of sound units or sound stations which may be composed of electronic musical instruments. However, the present invention is not limited to these embodiments, but may be applied to an electronic musical instrument in which a program is transferred among a plurality of CPUs involved in the instrument.

As described above, according to the invention, in a system or network of electronic musical instruments, which effects a substantially systemized or organized musical performance according to a plurality of separate programs, when one program is changed, modified or updated, the remaining programs are automatically changed, modified or updated consistently to the one program. Consequently, the invention provides various advantages such as loading of the separate programs into the respective instruments is facilitated, and the separate programs are correctly loaded so as to avoid inconsistency among the instruments.

What is claimed is:

1. A musical sound system operable according to one of a plurality of program sets, each program set comprising a system program and a corresponding control program, said musical sound system comprising:

a main unit operable based on a system program of one of said program sets for producing a musical sound; and a control unit operable based on a control program of one of said program sets for controlling the main unit;

said main unit including:

loading means for loading into said main unit a selected system program and a corresponding control program, and transmitting means for transmitting said loaded control program to said control unit.

2. The musical sound system of claim 1 further comprising:

a data source connected to the main unit through a communication channel, the data source including means for storing programs and data, and means responsive to a request from the main unit for transmitting thereto said stored programs and data.

3. The musical sound system of claim 1 wherein data defining said selected system program is stored with a header comprising data identifying said corresponding control program.

4. A musical sound network comprising:

a first station;

a second station connected to the first station; and a plurality of program sets each comprising a first program for controlling said first station and a corresponding second program for controlling said second station such that said first and second stations produce a cooperative musical production;

wherein the first station includes means for changing a currently loaded first program to a new first program, and the second station includes means for automatically in response thereto changing a currently loaded second program to a new second program, said new second program corresponding to said new first program.

5. A musical sound network according to claim 4, wherein said first station includes means for cancelling the change from said currently loaded first program to said new first program if said second station fails to automatically change said currently loaded second program to said new second program.

6. The musical sound network of claim 4 wherein data defining each first program is stored with a header comprising data identifying a corresponding second program.

7. The musical sound network of claim 5 wherein said second station includes means for changing a presently loaded second program to a different second program, and said first station includes means for automatically in response thereto changing a presently loaded first program to a different first program, said different first program corresponding to said different second program.

8. The musical sound network of claim 7 wherein data defining each second program is stored with a header comprising data identifying a corresponding first program.

* * * * *